US006769634B2

(12) United States Patent
Brenk et al.

(10) Patent No.: US 6,769,634 B2
(45) Date of Patent: Aug. 3, 2004

(54) INJECTION NOZZLE

(75) Inventors: Achim Brenk, Kaempfelbach-Bilfingen (DE); Wolfgang Klenk, Loechgau (DE); Uwe Gordon, Markgroeningen (DE); Manfred Mack, Altheim (DE)

(73) Assignee: Robert Bosch GmbH, Stuttgart (DE)

( * ) Notice: Subject to any disclaimer, the term of this patent is extended or adjusted under 35 U.S.C. 154(b) by 230 days.

(21) Appl. No.: 09/959,731

(22) PCT Filed: Feb. 24, 2001

(86) PCT No.: PCT/DE01/00727

§ 371 (c)(1),
(2), (4) Date: Feb. 19, 2002

(87) PCT Pub. No.: WO01/66932

PCT Pub. Date: Sep. 13, 2001

(65) Prior Publication Data

US 2003/0098371 A1 May 29, 2003

(30) Foreign Application Priority Data

Mar. 6, 2000 (DE) ..... 100 10 863

(51) Int. Cl.[7] ..... F02M 39/00

(52) U.S. Cl. ..... 239/533.3; 239/533.9; 239/533.12; 239/584; 239/444

(58) Field of Search ..... 239/88, 92, 443, 239/533.2, 533.3, 533.8, 444, 533.9, 584, 533.12, 533.4

(56) References Cited

U.S. PATENT DOCUMENTS

| | | | | | |
|---|---|---|---|---|---|
| 4,151,958 | A | * | 5/1979 | Hofmann | 239/533.3 |
| 4,382,554 | A | * | 5/1983 | Hofmann | 239/533.9 |
| 4,546,739 | A | * | 10/1985 | Nakajima et al. | 239/533.4 |
| 5,458,292 | A | * | 10/1995 | Hapeman | 239/533.4 |
| 5,899,389 | A | * | 5/1999 | Pataki et al. | 239/533.3 |
| 6,340,121 | B1 | * | 1/2002 | Lambert | 239/533.4 |
| 6,378,503 | B1 | * | 4/2002 | Lambert | 239/533.12 |
| 6,637,675 | B2 | * | 10/2003 | Carroll et al. | 239/533.9 |

FOREIGN PATENT DOCUMENTS

| | | |
|---|---|---|
| DE | 4115477 | * 11/1991 |
| DE | 4210563 | * 10/1992 |

* cited by examiner

*Primary Examiner*—Steven J. Ganey
(74) *Attorney, Agent, or Firm*—Ronald E. Greigg

(57) ABSTRACT

In a fuel injection nozzle having a nozzle body which body has one first and one second group of injection ports, one first and one second nozzle needle, and one separate pressure chamber for each nozzle needle, so that the injection needles are adjustable independently of one another between a closed position, in which the injection ports associated with the corresponding nozzle needle are closed, and an injection position, in which the corresponding injection ports are opened, a free choice of injection cross sections is to be made possible, while the design is simple. To that end, it is provided that the two nozzle needles adjoin one another.

14 Claims, 1 Drawing Sheet

INJECTION NOZZLE

CROSS-REFERENCE TO RELATED APPLICATIONS

This application is a 35 USC 371 application of PCT/DE 01/00727 filed on Feb. 24, 2001.

BACKGROUND OF THE INVENTION

1. Field of the Invention

The invention relates to a fuel injection nozzle having a nozzle body, which body has one first and one second group of injection ports, one first and one second nozzle needle, and one separate pressure chamber for each nozzle needle, so that the nozzle needles are adjustable independently of one another between a closed position, in which the injection ports associated with the corresponding nozzle needle are closed, and an injection position, in which the corresponding injection ports are opened. The invention also relates to a method for operating a fuel injection nozzle.

2. Description of the Prior Art

From German Patent Disclosure DE 40 23 223 A1, a fuel injection nozzle of this type is known. The injection ports of one group are each disposed along a circle, forming an inner circle and an outer circle concentric with it. The nozzle needle associated with the outer injection ports is embodied as a hollow cylinder, and the nozzle needle associated with the inner injection ports is disposed in the interior of the hollow nozzle needle. Between the inner nozzle needle and the outer nozzle needle is a separating sleeve, which is urged by a compression spring into contact with a sealing seat in the nozzle body, that is embodied between the two circles of injection ports. The inner injection ports are used for the pre-injection, while the outer injection ports are provided for the main injection. In each case, the separating sleeve assures that the two groups of injection ports remain separated from one another during the opening of the nozzle needles.

The comparatively high engineering expense is a disadvantage of this known construction. Since the injection ports of the two groups are located quite close together, both the two nozzle needles and the separation sleeve have to be accommodated in a very small space.

The object of the invention is to refine an injection nozzle of the type defined at the outset in such a way that a simpler design is achieved. Furthermore, flexible use of the two groups of injection ports is to be enabled by means of suitable triggering of the two nozzle needles. The object of the invention is also to create a method for operating an injection nozzle of the type defined at the outset.

SUMMARY OF THE INVENTION

The fuel injection nozzle of the invention has the advantage that the separation sleeve or a similar sealing element between the two nozzle needles can be dispensed with. This design is based on the recognition that sealing off of the applicable injection ports of one group, even when the nozzle needle is open, can be reliably attained for the injection ports of the other group without requiring a separate seal.

In a preferred embodiment of the invention, for at least one of the nozzle needles, a stop chamber is provided, which is provided with a hydraulic connection. In this way, a hydraulic stroke stop for the applicable nozzle needle is created that limits the opening motion of the nozzle needle more gently than a typical mechanical stroke stop. A longer service life of the nozzle needle is thus attained.

The method according to the invention offers the advantage that arbitrarily, the various injection ports can be used for the pre-injection and the main injection. In this way a vario effect can be attained, since by the suitable triggering of one of the two nozzle needles or both nozzle needles, the total cross-sectional area of the injection ports can be adapted to the particular injection. If for a relatively long time only one row of ports is activated, then by suitable, under some circumstances only brief, switchover to the other row of ports, carbonization of the first row of ports can be prevented. The method can in principle also be used in an injection nozzle in which between the two nozzle needles a separation sleeve is provided, which facilitates the sealing between the various rows of ports.

DESCRIPTION OF THE DRAWINGS

The invention is described below in terms of a preferred embodiment that is shown in the accompanying drawings in which.

DESCRIPTION OF THE PREFERRED EMBODIMENTS

Figure 1:
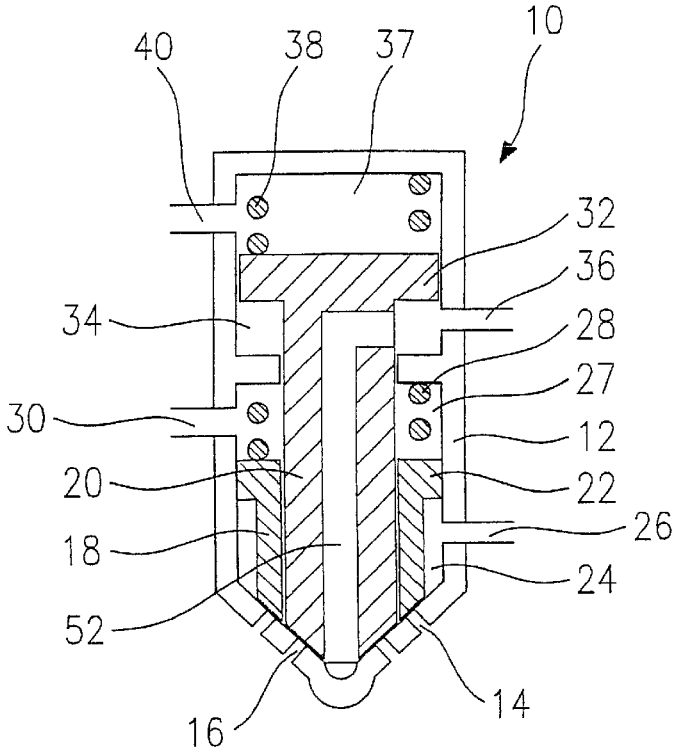
FIG. 1 schematically shows a fuel injection nozzle of the invention in cross section.

The injection nozzle 10 shown in FIG. 1 has a nozzle body 12, which is provided with two groups of injection ports 14, 16. The injection ports of each group are disposed along a circle, and the two circles formed are concentric, with the circle of the first injection ports 14 surrounding the circle formed by the second injection ports 16.

A first nozzle needle 18 and a second nozzle needle 20 are disposed in the interior of the nozzle body. The first nozzle needle 18 has an annular cross section, or in other words is hollow, and the second nozzle needle 20 is disposed in the interior of the first nozzle needle 18. The first nozzle needle 18 cooperates with the injection ports 14 of the first group, and the second nozzle needle 20 cooperates with the injection ports 16 of the second group. Each nozzle needle rests on the nozzle body 12 in such a way that in the radial direction, sealing of the applicable circle of injection ports is effected on the inside and the outside.

The first nozzle needle 18 is provided with a collar 22, which rests on the nozzle body 12, forming a pressure chamber 24. The pressure chamber is provided with a fuel connection 26, so that the pressure chamber 24 can be acted upon by pressure.

On the side of the collar 22 remote from the pressure chamber 24, a stop chamber 27 is formed, in which a compression spring 28 is disposed. The compression spring is braced on the nozzle body 12 and urges the first nozzle needle 18 toward the nozzle body 12, so that the injection ports 14 are closed. The stop chamber 27 is provided with a hydraulic connection 30, by means of which the pressure prevailing in the stop chamber 27 can be varied.

In a comparable way, the second nozzle needle 20 is provided with a collar 32, so that a pressure chamber 34 is formed, which is provided with a fuel connection 36, along with a stop chamber 37, in which a compression spring 38 is disposed and which chamber is provided with a hydraulic connection 40.

Figure 2:
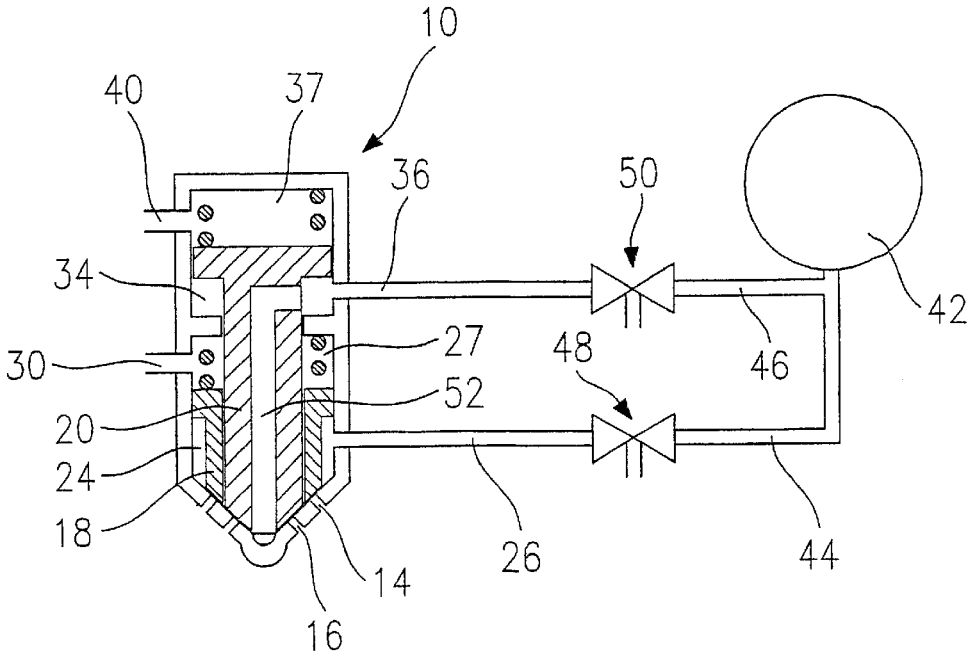
FIG. 2 schematically shows a fuel injection system in which the injection nozzle of FIG. 1 is used.

The mode of operation of the injection nozzle described will now be explained in conjunction with FIG. 2. The injection nozzle 10 is connected to a fuel injection system, which has a common rail 42 for the fuel to be injected. From it, supply lines 44, 46 lead to the fuel connections 26, 36, and switchable valves 48, 50 are provided by means of which the communication between the supply lines and the fuel connections can be opened and closed. Either 3/2-way valves can be used, or two 2/2-way valves at a time.

If the first pressure chamber 24 is supplied with fuel via the fuel connection 26, the first nozzle needle 18 opens as soon as the opening force generated in the pressure chamber 24 is greater than the closing force generated by the compression spring 28 and possibly by the pressure in the stop chamber 27. Fuel can then be injected through the injection ports 14. The hydraulic stop chamber 27 makes a gentle limitation of the opening stroke of the first nozzle needle 18 possible, and this limitation can be controlled variably by means of a switchable valve associated with the hydraulic connection 30.

In a comparable way, by supplying fuel via the fuel connection 36, an opening of the second nozzle needle 20 can be brought about. The fuel present in the pressure chamber 34 is then carried through a bore 52 in the interior of the second nozzle needle 20 to the front end of this needle, so that the fuel can emerge through the injection ports 16. Alternatively, an annular gap can be used between the first nozzle needle 18 and the second nozzle needle 20; in that case, sealing off from the stop chamber 27 of the first nozzle needle would have to be provided. The opening stroke of the second nozzle needle can likewise be controlled variably by means of the hydraulic stop chamber 37 and the hydraulic connection 40.

With the injection nozzle described, the injection cross section can be selected freely. Arbitrarily, either one or the other group of injection ports 14, 16 can be used, or even both groups of injection ports used simultaneously. For example, both the pre-injection and the main injection can be effected by opening the injection ports of one group, when the load is slight, while for full-load operation both groups of injection ports are used simultaneously for the injection. It is also possible during operation to switchover from one group of injection ports to the other, to avoid carbonization of the injection ports that are not in use at the time. In contrast to outward-opening injection nozzles, in which the use of different rows of injection ports means that the nozzle needle has to traverse long strokes, the present design creates an inward-opening injection nozzle, which at only slight engineering expense enables a free choice of the injection cross section at a short opening stroke of the applicable nozzle needle.

In an embodiment of the invention that is a departure from the above, the stop chambers can also be designed without a hydraulic connection 40, resulting in a further-simplified design. It is also possible to use a separation sleeve between the two nozzle needles, which at high operating pressures assures reliable sealing between the two groups of injection ports.

The foregoing relates to preferred exemplary embodiments of the invention, it being understood that other variants and embodiments thereof are possible within the spirit and scope of the invention, the latter being defined by the appended claims.

What is claimed is:

1. A fuel injection nozzle comprising a nozzle body (12) having one first and one second group of injection ports (14, 16), one first nozzle needle (18) and one second nozzle needle (20), and one separate pressure chamber (24, 34) for each nozzle needle, whereby the nozzle needles are adjustable independently of one another between a closed position, in which the injection ports associated with the corresponding nozzle needle are closed, and an injection position, in which the corresponding injection ports are opened, said two nozzle needles (18, 20) adjoining one another, the first nozzle needle having a stop chamber (27) and the second nozzle needle (20) being positioned within the stop chamber (27) of the first nozzle needle (18).

2. The injection nozzle of claim 1, wherein said injection ports (14, 16) are each disposed along a circle; that the first nozzle needle (18) is hollow; and that the second nozzle needle (20) extends through the first nozzle needle (18).

3. The injection nozzle of claim 2, wherein fuel for the injection ports associated with the second nozzle needle (20) is delivered through a free space between the first and second nozzle needles (18, 20).

4. The injection nozzle of claim 3, further comprising a stop chamber (27, 37) for at least one of the nozzle needles, each said stop chamber (27, 37) being provided with a hydraulic connection (30, 40).

5. The injection nozzle of claim 4, wherein a compression spring (28, 38) is disposed in each said stop chamber.

6. The injection nozzle of claim 2, further comprising a stop chamber (27, 37) for at least one of the nozzle needles, each said stop chamber (27, 37) being provided with a hydraulic connection (30, 40).

7. The injection nozzle of claim 6, wherein a compression spring (28, 38) is disposed in each said stop chamber.

8. A fuel injection nozzle comprising a nozzle body (12) having one first and one second group of injection ports (14, 16), one first and one second nozzle needle (18, 20), and one separate pressure chamber (24, 34) for each nozzle needle, whereby the nozzle needles (18, 20) are adjustable independently of one another between a closed position, in which the injection ports associated with the corresponding nozzle needle are closed, and an injection position, in which the corresponding injection ports are opened, said two nozzle needles (18, 20) adjoining one another, wherein fuel for the injection ports associated with the second nozzle needle (20) is delivered through a bore in the interior of the second nozzle needle (20).

9. The injection nozzle of claim 8, further comprising a stop chamber (27, 37) for at least one of the nozzle needles, each said stop chamber (27, 37) being provided with a hydraulic connection (30, 40).

10. The injection nozzle of claim 9, wherein a compression spring (28, 38) is disposed in each said stop chamber.

11. A fuel injection nozzle comprising a nozzle body (12) having one first and one second group of injection ports (14, 16), one first and one second nozzle needle (18, 20), and one separate pressure chamber (24, 34) for each nozzle needle, whereby the nozzle needles (18, 20) are adjustable independently of one another between a closed position, in which the injection ports associated with the corresponding nozzle needle are closed, and an injection position, in which the corresponding injection ports are opened, said two nozzle needles (18, 20) adjoining one another, further comprising a stop chamber (27, 37) for each of the nozzle needles, each said stop chamber (27, 37) being provided with a hydraulic connection (30, 40).

12. The injection nozzle of claim 11, wherein a compression spring (28, 38) is disposed in each said stop chamber.

13. The injection nozzle of claim 11, further comprising a compression spring (28, 38) disposed in each said step chamber (27, 37), and a valve associated with the hydraulic connection (30, 40) of each stop chamber (27, 37).

14. A fuel injection nozzle comprising a nozzle body (12) having one first and one second group of injection ports (14, 16), one first and one second nozzle needle (18, 20), and one separate pressure chamber (24, 34) for each nozzle needle, whereby the nozzle needles (18, 20) are adjustable independently of one another between a closed position, in which the injection ports associated with the corresponding nozzle needle are closed, and an injection position, in which the corresponding injection ports are opened, further comprising a stop chamber (27) for at least the first nozzle needle (18), each of the pressure chambers (24, 34) and the stop chamber (27) being in axial alignment.

* * * * *